United States Patent [19]

Cutler

[11] 4,070,023

[45] Jan. 24, 1978

[54] NUNCHAKU

[75] Inventor: Jerome J. Cutler, Philadelphia, Pa.

[73] Assignee: Strong Design Research and Sales Corporation, Philadelphia, Pa.

[21] Appl. No.: 707,966

[22] Filed: July 23, 1976

[51] Int. Cl.[2] ..... F41B 15/02

[52] U.S. Cl. ..... 273/84 R

[58] Field of Search ..... 273/84 R; 272/75; 135/15 PQ; 46/47, 51, 52; 231/2 R

[56] References Cited

U.S. PATENT DOCUMENTS

| | | | |
|---|---|---|---|
| 674,431 | 5/1901 | Black | 272/75 |
| 3,363,898 | 1/1968 | Crovello | 272/75 |
| 3,608,899 | 9/1971 | Hall | 273/84 R |
| 3,730,544 | 5/1973 | Hyman | 135/15 PQ X |
| 3,963,037 | 6/1976 | Clark | 135/15 PQ X |

FOREIGN PATENT DOCUMENTS

| | | | |
|---|---|---|---|
| 1,507,343 | 11/1967 | France | 272/75 |
| 1,217,867 | 12/1970 | United Kingdom | 272/75 |

*Primary Examiner*—Richard J. Apley
*Attorney, Agent, or Firm*—Seidel, Gonda & Goldhammer

[57] ABSTRACT

First and second hollow metal members are innerconnected by a rope for use by police, military, and students of martial arts. The rope may be of wire or nylon and is freely slideable with respect to one of the metal members while being freely rotatable with respect to said one member.

10 Claims, 4 Drawing Figures

NUNCHAKU

BACKGROUND

A nunchaku is a martial arts device having its origins in the Far East. A typical nunchaku device involves two rigid wooden members innerconconected at one end by a rope of natural fibers. The wooden members are subject to cracking, splintering, and vary as to moisture content depending on humidity, etc.

The present invention modernizes a conventional nunchaku so that it can be used as an effective device for offense or defense by military, police, guards, students of martial arts, etc.

SUMMARY OF THE INVENTION

The apparatus of the present invention includes first and second rigid members which are preferably hollow metal members. Each metal member is provided with a bore at one end thereof. A rope extends through the bores and innerconnects the metal members. Each end of the rope terminates within one of the metal members.

At least one end portion of the rope is freely slideable with respect to its associated metal member so that the distance between the bore ends of the metal members can be decreased. A means is associated with the ends of the rope to limit the maximum extent of the distance between the bore ends of the metal members.

In a preferred embodiment of the present invention, the metal members are of a lightweight, non-corrosive material such as aluminum which is perforated. The perforations minimize slippage and decrease the weight of the device so that its total weight is 1 pound.

It is an object of the present invention to provide a novel nunchaku which is stronger, more durable, while being more versatile than comparable devices proposed heretofore.

Other objects will appear hereinafter.

For the purpose of illustrating the invention, there is shown in the drawings a form which is presently preferred; it being understood, however, that this invention is not limited to the precise arrangements and instrumentalities shown.

Referring to the drawing in detail, wherein like numerals indicate like elements, there is shown in FIG. 1 a device in accordance with the present invention designated generally as 10.

Figure 3:
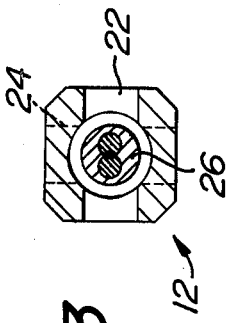
FIG. 3 is a sectional view taken along the line 3—3 in FIG. 2.
Figure 4:
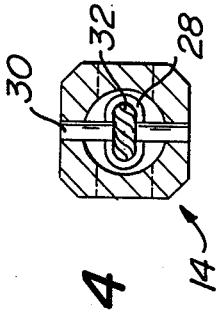
FIG. 4 is a sectional view taken along the line 4—4 in FIG. 2.
Figure 1:
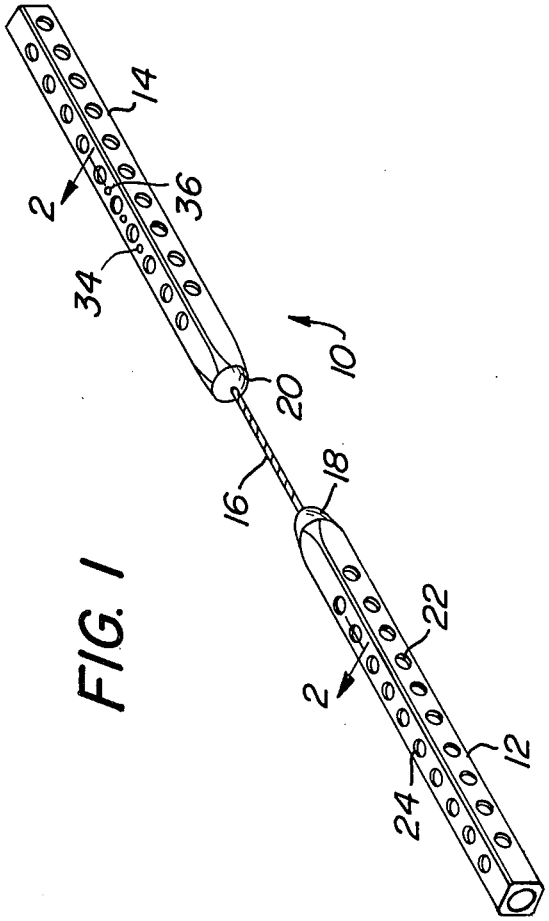
FIG. 1 is a perspective view of the apparatus of the present invention.
Figure 2:
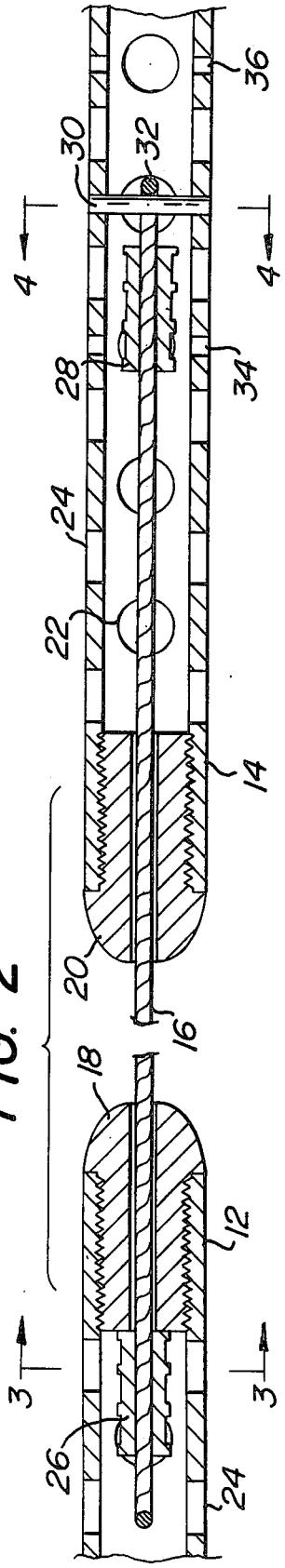
FIG. 2 is an enlarged sectional view taken along the line 2—2 in FIG. 1.

The device 10 includes a first rigid member 12 and a second rigid member 14 innerconnected at adjacent ends by a rope 16. Each of the members 12 and 14 are rigid hollow metal members having a length of one foot. The metal members 12 and 14 are preferably made from aluminum. The members are preferably rectangular in cross section with beveled corners. In a typical embodiment of the invention, the distance across major faces is 0.875 inches with the central bore being 0.55 inches.

Each of the members 12 and 14 is perforated along substantially its entire length. The members are perforated by drilling holes 22 across the side faces and staggered holes 24 across the top and bottom faces. The holes 22, 24 provide a whistling sound when one metal member is held and the other member is whipped through the air. Also, the holes 22, 24 facilitate a sure grip when being held in the hands.

Each of the members 12 and 14 is preferably anodized aluminum. Member 12 has an adaptor 18 threadedly connected to its inner diameter. Member 14 is provided with a similar adaptor 18. The exposed head of the adaptors 18, 20 is preferably a semi-spherical shape. The adaptors 18, 20 have a central bore through which the rope 16 extends. The adaptors facilitate assembly and disassembly of the device.

The rope 16 is of finite length whereby each of its ends is disposed within one of the members 12 and 14. Rope 16 may be a nylon cable, aluminum cable, steel cable, etc. The end of rope 16 disposed within the member 12 is looped back on itself and then secured thereto by a retainer 26. The outer diameter of the retainer 26 is greater than the diameter of the bore in adaptor 18. The end portion of rope 16 disposed within member 12 can rotate with respect to said member 12 and can slide relative to member 12 as member 14 is moved toward member 12. The length of such sliding movement is limited by the distance between the adjacent ends of the adaptors 18, 20.

The preferred distance between the adjacent ends of the adaptors 18, 20 and thereby the length of the exposed portion of the rope 16 is 2½ inches. The length of the exposed portion of rope 16 may be increased substantially, that is, up to 5 inches, if desired. In this regard, the end of the rope 16 disposed within the metal member 14 is secured thereto in an adjustable manner. A steel pin 30 extends through and has a force fit in aligned holes on the member 14. The end of the rope 16 within member 14 is in the form of a loop 32 with the free end of the rope and the remainder thereof secured together by retainer 28. The pin 30 extends through the loop 32. By applying force in an axial direction on pin 30 by way of a convenient tool, the pin 30 may be removed from its associated hole. Member 14 is provided with sets of holes 34 and 36, each of which may receive the pin 30 to thereby increase or decrease the length of the exposed portion of rope 16.

The device 10 may be used as an offensive or defensive weapon by military, guards, police, and students of martial arts. The ability of the rope 16 to slide and/or rotate relative to member 12 provides flexibility in manipulation of the device 10. The construction of the device 10 as described above and illustrated in the drawings provides for great flexibility in manipulation, minimizing slip, increases durability and long life, while having aerodynamic features as presented by the structural configuration and the holes 22, 24 and the metal members 12 and 14.

The device 10 may be manipulated in many ways. Device 10 may be used offensively by holding it only at the free end portion of member 12 or 14. When thusly used, device 10 functions with greater versatility than a billey club. Device 10 may be used defensively by holding it at the free end portion of each of members 12 and 14. When thusly used, the rope 16 permits members 12 and 14 to be at different angular positions.

A wide variety of metals and alloys are available for use in constructing members 12 and 14. I prefer to make members 12 and 14 from a 6061 TT651 aluminum alloy so as to take advantage of its hardness, high strength, and light weight and ease of machining.

The present invention may be embodied in other specific forms without departing from the spirit or essential attributes thereof and, accordingly, reference should be made to the appended claims, rather than to the foregoing specification as indicating the scope of the invention.

It is claimed:

1. A hand weapon comprising first and second hollow members of metal, said metal members having transverse perforations, a discrete threaded adapter threaded in one end of each of said members, the transverse dimensions of said adapters being not greater than the transverse dimensions of their associated metal member, each adapter having a central bore, a flexible member extending through said bores and interconnecting said metal members, means associated with the free ends of said flexible member for preventing the flexible member from being withdrawn through the bore of its associated adapter, means associated with one end portion of said flexible member and its hollow metal member for adjusting the length of the flexible member exposed between said adapters, the exposed end portion of said adapters being conical or semispherical, and said metal members having a plurality of flat faces thereon.

2. A device in accordance with claim 1 wherein said hollow metal members are aluminum and have a length of approximately 1 foot.

3. A device in accordance with claim 1 wherein said flexible member is in the form of a cable made from a material selected from the group consisting of steel, aluminum and nylon.

4. A device in accordance with claim 1 wherein the other end portion of said flexible member is freely rotatable with respect to its associated member.

5. A device in accordance with claim 1 wherein said adjusting means includes a transverse pin and spaced sets of holes in the associated hollow metal member, said pin being received in one of said sets of holes and being coupled to said one end portion of said flexible member.

6. A weapon in accordance with claim 1 wherein said exposed portion of said flexible member is less than about 5 inches.

7. A device comprising first and second hollow members of rigid metal, each of said metal members having a bore at one end thereof, a rope extending through said bores and interconnecting said members, each end of said rope terminating within one of said metal members, at least one end portion of said rope being freely slideable with respect to its metal members so that the distance between the bore ends of said metal members may be decreased, means associated with ends of said rope to limit the extent of the distance between said bore ends of said metal members, and said metal members being provided with staggered sets of holes therethrough in a direction generally perpendicular to the longitudinal axes of said metal members.

8. A device comprising first and second hollow members of rigid metal, each of said metal members having a bore at one end thereof, a rope extending through said bores and interconnecting said members, each end of said rope terminating within one of said metal members, at least one end portion of said rope being freely slideable with respect to its metal members so that the distance between the bore ends of said metal members may be decreased, means associated with ends of said rope to limit the extent of the distance between said bore ends of said metal members, and said metal members being of a lightweight metallic material which is rectangular in cross section with beveled corners.

9. A device comprising first and second members of hollow aluminum, said members having tarnsverse perforations, said members having a length of approximately 1 foot, a discrete threaded adaptor in one end of each of said members, each adaptor having a central bore, a rope extending through said bores and innerconnecting said metal members, each end of said rope terminating within one of said metal members, one end portion of said rope being freely rotatable and slideable with respect to the first metal member, the other end portion of said rope being adjustably connected to said second metal member, and means associated with each end portion of said rope to limit the maximum extent of the distance between said adaptors to thereby define the extent of the exposed portion of said rope.

10. A device in accordance with claim 9 wherein the juxtaposed ends of said adaptors are generally semispherical, the outer diameter of each adaptor being threaded to the inner diameter of its associated metal member, the total effective length of said rope being approximately equal to the length of said first member, and the perforations on adjacent faces of said first and second members being staggered.

* * * * *